United States Patent [19]

Nakagawa

[11] Patent Number: 4,990,074

[45] Date of Patent: Feb. 5, 1991

[54] OIL PUMP HAVING PIVOTING VANES

[75] Inventor: Takashi Nakagawa, Kariya, Japan

[73] Assignee: Aisin Seiki Kabushiki Kaisha, Kariya, Japan

[21] Appl. No.: 409,722

[22] Filed: Sep. 20, 1989

[30] Foreign Application Priority Data

Sep. 27, 1988 [JP] Japan ..... 63-241544

[51] Int. Cl.[5] ..... F04C 2/44

[52] U.S. Cl. ..... 418/172; 418/268

[58] Field of Search ..... 418/172, 176, 268

[56] References Cited

U.S. PATENT DOCUMENTS 1,818,430 8/1931 Ricardo ..... 418/172

2,841,090 7/1958 Nuerwell ..... 418/176

FOREIGN PATENT DOCUMENTS 0100394 4/1989 Japan ..... 418/172

2098278 11/1982 United Kingdom ..... 418/172

*Primary Examiner*—John J. Vrablik

*Assistant Examiner*—David L. Cavanaugh

*Attorney, Agent, or Firm*—Oblon, Spivak, McClelland, Maier & Neustadt

[57] ABSTRACT

The oil pump includes an air tight housing within which is rotatably fitted a circular ring and a driven shaft rotatably mounted in the housing, and within the ring, for rotation about an axis eccentric from, but substantially parallel to, the ring axis. An inner rotor in the circular ring is mounted to the driving shaft for rotation therewith and a plurality of circumferentially spaced vanes each have an inner end pivotally mounted to the rotor. Each of the vanes is oriented with respect to a radial direction such that the vanes are centrifugally swung radially outward and into contact with the ring in response to rotation of the driving shaft and the inner rotor, thereby providing airtight pump chambers between adjacent ones of the vanes. Intake and discharge ports are respectively communicated with the pump chambers at circumferential positions thereof where the pump chambers are expanding and contracting, so that oil from the intake port is pumped by the pump chambers to the discharge port.

5 Claims, 2 Drawing Sheets

OIL PUMP HAVING PIVOTING VANES

BACKGROUND OF THE INVENTION

1. Field of the Invention

This invention relates to an oil pump, and more particularly to an oil pump used for vehicle engines.

2. Description of the Related Art

In a conventional oil pump which is used for an internal combustion engine for vehicles, an internal-external gear pump is mainly utilized. A dual type vane pump is conventionally proposed for a power steering device for vehicles as shown in Japanese Patent Publication No. 62 (1987) - 26300. The dual type vane pump is shown in FIGS. 3 and 4, and includes a front pump 1 and a rear pump 2 which are rotatably driven by a common pump shaft 3.

The pump shaft 3 penetrates the front pump 1 and a drive pulley 4 is attached to a projecting end of the pump shaft 3. The front pump 1 is comprised with a front body and a cam ring 6 within which is inserted a rotor 7. A common center plate 8 is common to the front pump and the rear pump 2 comprised of a rear body 9 and a cam ring 11 within which inserted a rotor 10. The front and rear pumps 1 and 2 are integrally connected by means of a plurality of bolts 12 which extend parallel with the pump shaft 3.

The cam ring 6 is fixedly clamped between the front body 5 and the center plate 8 in the front pump 1. The distal ends of a plurality of vanes 13 radially arranged in the rotor 7 contact with an inner circumferential cam surface of the cam ring 6, thereby forming a pump chamber 14 between each pair of vanes 13. An intake port 15 is provided on a contacting surface 8A of the canter plate 8 so as to be located at a circumferential region where the volume of the pump chamber 14 is enlarged in accordance with the rotation of the rotor 7. Further, a discharge port 16 is provided on a contacting surface 5A of the front body 5 so as to be located at a circumferential region where the pump chamber 14 volume is at a minimum. Accordingly, actuating oil sucked from the intake port 15 into the pump chambers 14 is pumped in accordance with the rotation of the rotor 7.

An intake port 24 for the common actuating oil, common to both pumps, is attached to the front body 5 and is communicated with an excess oil passage 31 of a flow control valve 30 interposed within the front body 5. The intake port 24 is further communicated with an inlet 27A opened to the contacting surface 8A of the center plate 8 via a connecting passage 26 formed on the cam ring 6 by a passage port 25 opened to the contacting surface 5A, thereby forwarding the actuating oil from the intake port 24 into the intake passage 21. The actuating oil flows from an inlet port 27B opened to the contacting surface 8B of the center plate 8 to the intake passage 21 via an excess oil passage 33 of a flow control valve 32 disposed in the rear body 9 opposedly located via a connecting passage 29 formed on the cam ring 11. The discharge pressure is applied to the slit grooves in which the vanes 13 slide so that the vanes 13 are pressed radially outward and contact with an inner circumferential surface of the pump chamber 14. The clearance of the vanes 13 in the slit grooves must be maintained with high accuracy in order to prevent binding of the vanes. However, when the vane pump is used for pumping a lubrication oil of the vehicle engine, foreign matter within the oil pan is invaded into the slit groove and the vane pump cannot be operated reliably.

SUMMARY OF THE INVENTION

It is therefore an object of the present invention to provide an oil pump which can obviate the above drawbacks of the conventional devices.

It is another object of the present invention to provide an oil pump which an eliminate noise generated by the pump.

It is a further object of the present invention to provide an oil pump which can minimize wear of the pump vanes.

The above, and other, objects are achieved according to the present invention by an oil pump comprising an air tight housing within which is rotatably fitted a circular ring and a driven shaft rotatably mounted in the housing, and within the ring, for rotation about an axis eccentric from, but substantially parallel to, the ring axis. An inner rotor in the circular ring is mounted to the driving shaft for rotation therewith and a plurality of circumferentially spaced vanes each have an inner end pivotally mounted to the rotor. Each of the vanes is oriented with respect to a radial direction such that the vanes are centrifugally swung radially outward and into contact with the ring in response to rotation of the driving shaft and the inner rotor, thereby providing airtight pump chambers between adjacent ones of the vanes. Intake and discharge ports are respectively communicated with the pump chambers at circumferential positions thereof where the pump chambers are expanding and contracting, so that oil from the intake port is pumped by the pump chambers to the discharge port.

According to a further feature of the invention, tapered support faces on the inner rotor comprise means for limiting a pivotal angle of the vanes such that the vanes will contact the ring. This permits various vane shapes, such as club shaped vanes which are highly responsive to centrifugal force.

According to a further feature of the invention, the contact between the vanes and the ring comprise means for rotating the ring, so that frictional wear between the vanes and the ring is minimized.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
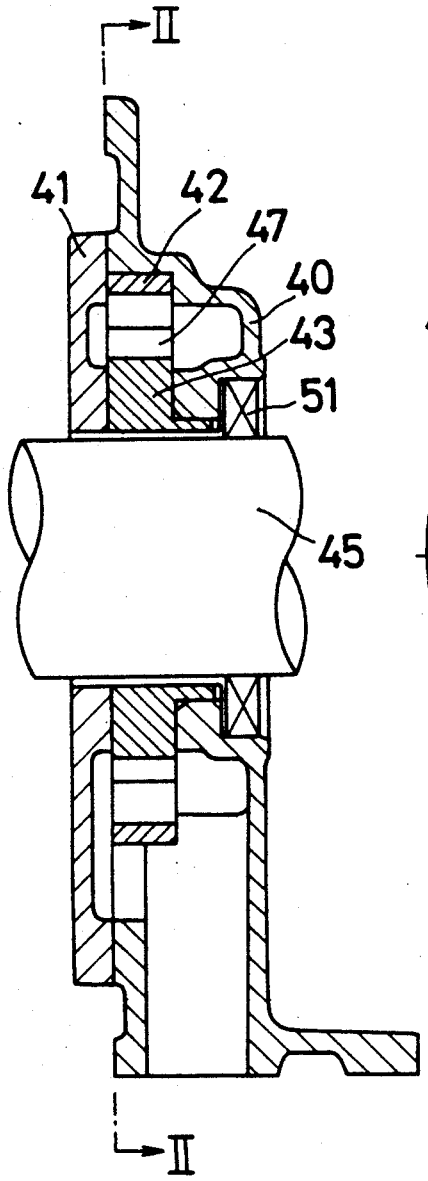
FIG. 1 is a lateral sectional view of a preferred embodiment of an oil pump according to the present invention.
Figure 2:
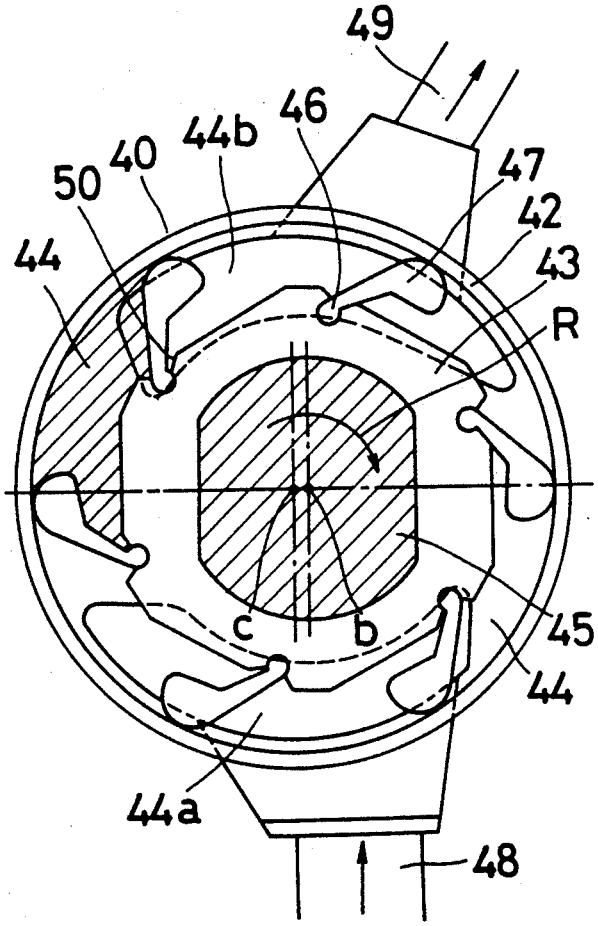
FIG. 2 is a sectional view at II—II in FIG. 1.
Figure 3:
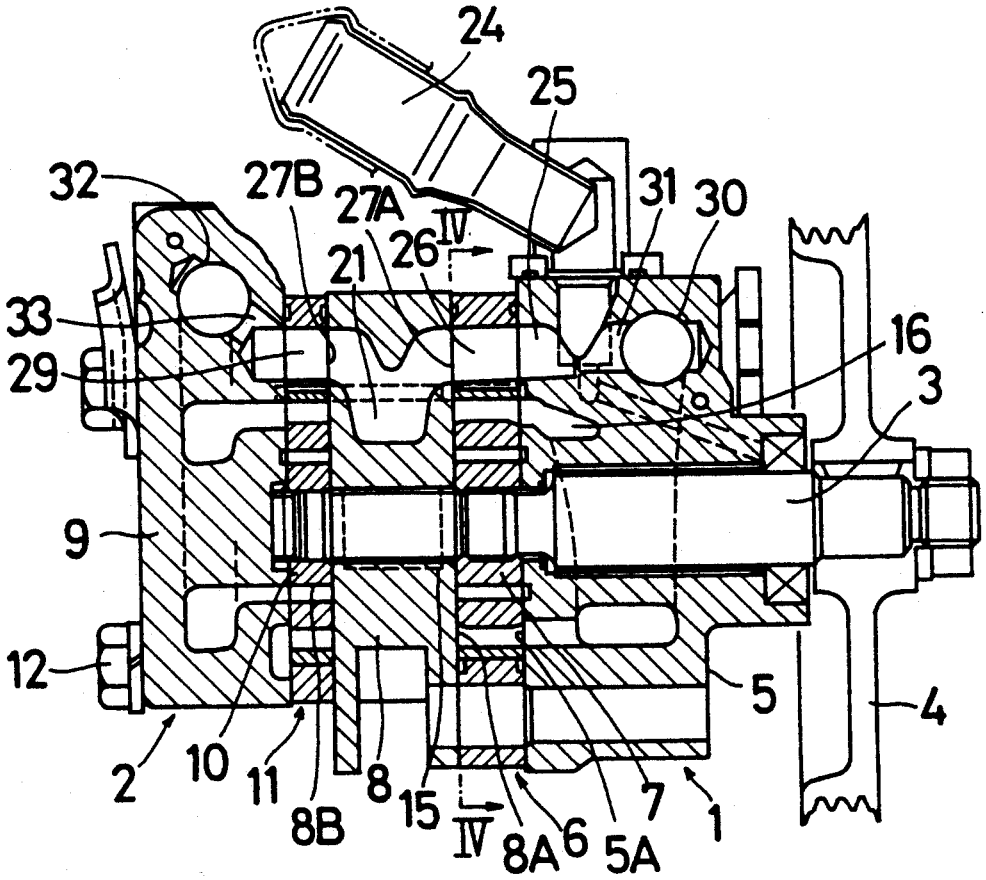
FIG. 3 PRIOR ART
FIG. 3 is a view similar to FIG. 1, but showing a conventional vane pump.
Figure 4:
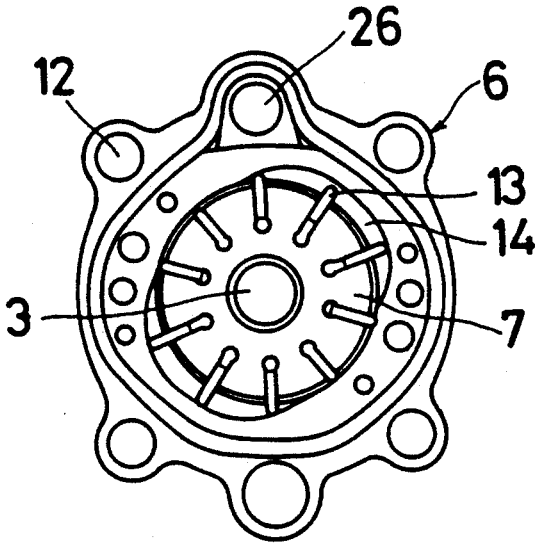
FIG. 4 PRIOR ART
FIG. 4 is a view similar to FIG. 2, but taken along IV—IV in FIG. 3.

Referring to FIGS. 1 and 2 showing an oil pump according to the present invention, a reference numeral 40 is a body of the oil pump and a reference numeral 41 is a cover fixed to the body 40. An airtight housing for accommodating a circular ring 42 and an inner rotor 43 is formed by the body 40 and the cover 41. The circular ring 42 is rotatably provided in an inner circumferential portion of the body 40. A driving shaft 45 having a center c located eccentric from, but parallel to, the center b of the ring 42 is rotatably journaled in the body 40. The inner rotor 43 is connected to the driving shaft 45 for rotation therewith, for example via the flats 45*a* on the driving shaft. A plurality of vanes 47 are pivotally supported on rotor 43 at outer circumferential portions of the inner rotor 43. Each of the vanes 47 has an inner end 46 pivoted to the inner rotor 43 about a pivot axis extending substantially parallel to the centers b and c. Preferably, the vanes are club shaped with enlarged head portions opposite the inner ends. All of the pivot axes are substantially equidistant from the center c. An outer end surface of each vane 47 can pivot to contact an inner circumferential surface of the circular ring 42 by centrifugal force when the driving shaft 45 is turned, to form pump chambers 44 between adjacent vanes. The club shape of the vanes causes the center of gravity thereof to be further from the inner ends thereof, so that they are more responsive to centrifugal force.

A reference numeral 48 is an intake inlet communicated with an airtight space 44*a* in cover 41, at a circumferential position where the pump chambers 44 begin enlargement. Reference numeral 49 is a discharge port communicated with an airtight space 44*b* in cover 41 at a circumferential position when the pump chamber volume is at a minimum.

A reference numeral 50 is a tapered support surface provided on the rotor 43 at the upstream side, in the rotational direction R, of each inner end 46. The support surface 50 acts as a stop means to limit the pivoting angle of the vanes 47 so that the vanes always contact the ring 42 when the vanes are at a minimum volume position for the adjacent pump chambers 44. When a side surface of a vane 47 engages the support surface 50, the vane 47 cannot be further pivoted from this position to permit the oil pressurized at the upstream airtight pump chamber 44 to escape to the downstream airtight pump chamber, which would result from such further pivoting. A reference numeral 51 is a seal member.

The operation according to the present invention is hereinbelow described.

Since the vanes 47 are angled upstream with respect to the radial direction they receive a centrifugal force in accordance with the rotation of the inner rotor 43 which causes them to pivot towards the radial direction, i.e., to pivot so as to contact the inner circumferential surface of the circular ring 42. The airtight pump chambers 44 formed by adjacent vanes 47, ring 42 and inner rotor 43 repeatedly enlarge and contract in volume according to the rotation of the inner rotor 43. Accordingly, the oil is sucked from the intake inlet 48 into the airtight space 44*a*, is gradually compressed in the pump chambers and is discharged from the front airtight space 44*b*. As a result, the oil is discharged from the discharge outlet 49. At this time, the ring 42 is rotated with the vanes 47, because the vanes 47 contact the circular ring 42, and so the circular ring 42 receives a rotating force from the vanes 47.

As aforementioned, in the oil pump according to the present invention the vanes 47 are pivoted around their inner ends 46 by centrifugal force in accordance with the rotation of the inner rotor 43 and contact the inner circumferential surface of the circular ring 42. Further, the vanes are pressed outward by the discharging pressure of the oil in the upstream airtight pump chamber 44, so that the sealing between the vanes and the inner circumferential surface of the circular ring can be maintained. Accordingly, manufacturing with high accuracy as in the sliding groove of the vane according to the conventional vane pump is not required at the supporting portion of the inner rotor for the vanes in the present invention. The circular ring 42 is rotatably provided, so that the ring is rotated with the vanes 47 due to the contact with the vane. Accordingly, frictional heating of the distal ends of the vanes is avoided.

It should be understood that, although the preferred embodiment of the present invention has been described herein in considerable detail, certain modifications, changes, and adaptations may be made by those skilled in the art and that it is hereby intended to cover all modifications, changes and adaptations thereof falling within the scope of the appended claims.

What is claimed as new and desired to be secured by Letters Patent of the United States is:

1. An oil pump comprising:

an airtight housing;

a circular ring fitted in said housing for rotation about a ring axis;

a driving shaft rotatably mounted in said housing and within said ring for rotation in a direction of rotation about an axis eccentric from but substantially parallel to, and ring axis;

an inner rotor in said circular ring and mounted to said driving shaft for rotation therewith;

a plurality of circumferentially spaced vanes, each having an inner end pivotally mounted to said rotor about a pivot axis, each of said vanes being oriented with respect to a radial direction such that said vanes are centrifugally swung radially outward and into contact with said ring in response to rotation of said driving shaft and said inner rotor in said direction of rotation, whereby airtight pump chambers are formed between adjacent ones of said vanes;

tapered support surfaces on said inner rotor against which said inner ends of said vanes bear, said support surfaces comprising means for limiting a pivoting angle of said vanes such that said vanes will substantially contact said ring when said vanes are at a minimum volume position of said pump chambers; and intake and discharge ports respectively communicating with said pump chambers at circumferential positions thereof where said pump chambers are expanding and contracting, whereby oil from said intake port is pumped by said pump chambers to said discharge port.

2. The oil pump of claim 1 wherein said pivot axes are substantially equidistant from said driving shaft axis.

3. The oil pump of claim 2 wherein said pivot axes extended substantially parallel to said driving shaft axis.

4. The oil pump of claim 1 wherein said contact between vanes and said ring comprises means for rotating said ring, whereby frictional wear between said vanes and said ring is minimized.

5. The oil pump of claim 4, wherein said vanes are club shaped with an enlarged head portion opposite said inner ends, whereby said vanes are responsive to centrifugal force.

* * * * *